US007644523B2

(12) United States Patent
Buckner

(10) Patent No.: US 7,644,523 B2
(45) **Date of Patent: *Jan. 12, 2010**

(54) MOBILE VACUUM BORING AND EXCAVATION METHOD

(76) Inventor: Lynn Allan Buckner, P.O. Box 609, Chickamauga, GA (US) 30707

( * ) Notice: Subject to any disclaimer, the term of this patent is extended or adjusted under 35 U.S.C. 154(b) by 180 days.

This patent is subject to a terminal disclaimer.

(21) Appl. No.: 11/208,565

(22) Filed: Aug. 22, 2005

(65) Prior Publication Data

US 2006/0032095 A1 Feb. 16, 2006

Related U.S. Application Data

(63) Continuation-in-part of application No. 10/217,055, filed on Aug. 12, 2002, now Pat. No. 6,988,568.

(60) Provisional application No. 60/363,058, filed on Mar. 11, 2002, provisional application No. 60/384,719, filed on Jun. 3, 2002.

(51) Int. Cl.
*E02F 5/00* (2006.01)

(52) U.S. Cl. ..... 37/304; 37/317; 37/323; 37/466; 37/905

(58) Field of Classification Search ..... 37/317, 37/320, 304, 466, 905
See application file for complete search history.

(56) References Cited

U.S. PATENT DOCUMENTS

| | | | | | |
|---|---|---|---|---|---|
| 3,512,206 | A * | 5/1970 | Young | 15/346 |
| 5,016,717 | A * | 5/1991 | Simons et al. | 175/66 |
| 5,295,317 | A * | 3/1994 | Perrott | 37/348 |
| 5,408,766 | A * | 4/1995 | Pobihushchy | 37/323 |
| 5,487,228 | A * | 1/1996 | Marazzo et al. | 37/317 |
| 5,791,073 | A * | 8/1998 | Palmer et al. | 37/317 |
| 5,860,232 | A * | 1/1999 | Nathenson et al. | 37/466 |
| 5,946,767 | A * | 9/1999 | Sinz | 15/302 |
| 6,202,330 | B1 * | 3/2001 | Bolton | 37/403 |
| 6,385,867 | B1 * | 5/2002 | Slabach et al. | 37/304 |
| 6,453,584 | B1 * | 9/2002 | Buckner | 37/323 |
| 6,470,605 | B1 * | 10/2002 | Gilman et al. | 37/323 |
| 6,547,964 | B1 * | 4/2003 | Rajewski | 210/241 |
| 6,604,304 | B1 * | 8/2003 | Slabach et al. | 37/304 |
| 6,860,042 | B2 * | 3/2005 | Hutchinson et al. | 37/322 |
| 6,988,568 | B2 * | 1/2006 | Buckner | 175/67 |
| 2005/0210623 | A1 * | 9/2005 | Buckner | 15/340.1 |

* cited by examiner

*Primary Examiner*—Thomas A Beach
*Assistant Examiner*—Matthew R Buck

(57) ABSTRACT

A compact mobile vacuum boring, mud recovery, excavation and surface cleaning method comprising a device which will create a vacuum condition within a vacuum container and the vacuum container may be mounted on an incline slope to provide space beneath it to locate a water storage container. A vacuum conduit may be used to transport liquid or solid particles into the vacuum container. The vacuum conduit may be mounted adjacent to an articulated boom with one or more elbows and arms and the boom arm may have multiple utilities and tools attached. The vacuum tank may be mounted at a slope sufficient to assist emptying it's contents by gravity. An air filter housing may be adjacently mounted above the vacuum tank for efficiency and compactness. A dispensing device may be added to dispense a liquid or a solid from the vacuum container without eliminating the vacuum environment within the vacuum container, and said vacuum container having the ability to fill, store and dispense its contents simultaneously. The vacuum container may further comprise a means to separate a liquid from solids.

24 Claims, 10 Drawing Sheets

Fig. 9 Cross Section

Cross Section

MOBILE VACUUM BORING AND EXCAVATION METHOD

This application claims the benefit of U.S. Non Provisional Application Ser. No. 09/722,797 filed 27 Nov. 2000 and U.S. Non Provisional Application Ser. No. 10/217,055 filed 12 Aug. 2002 to include it's 24 Sep. 2002 & 12 Mar. 2003 amendment and U.S. Provisional Application No. 60/363,058 filed on 11 Mar. 2002 and U.S. Provisional Application No. 60/384,719 filed on 3 Jun. 2002, which were parent cases of CIP Ser. No. 10/217,055 filed Aug. 12, 2002 now U.S. Pat. No. 6,988,568.

BACKGROUND OF THE INVENTION

1. Field of the Invention

The present invention relates to a vacuum boring and mud recovery method comprising a device which will create a vacuum condition within a vacuum container and the vacuum container is mounted on a sufficient incline to allow debris to be empted out by gravity and to provide space beneath the debris tank to locate a water storage container and having a vacuum conduit to transport a liquid and or solid particles into the vacuum container. A dispensing device may be added to dispense a liquid or a solid from the vacuum container without eliminating the vacuum environment within the vacuum container, and said vacuum container having the ability to fill, store and dispense its contents simultaneously. The vacuum container may further comprises a means to separate a liquid and from solids. Said vacuum conduit articulated boom used to transport debris into the vacuum container may have the added feature or attachments chosen from an earth digging bucket, a telescoping vacuum conduit, sensor to locate buried utilities, monitors and controls to operate the attachments an their function, water spray nozzle, man hole cover remover, cutting tool, grinding tool, saw, blasting tool, surface cleaning tool, demolition tool, torque wrench, tractor to pull vacuum hose, jetter nozzle, or camera and power source to operate them. The above described vacuum system may be mounted on a variety of mobile platforms, chosen from but not limited to a trailer, truck, skid steer, fork lift, track hoe, railroad car, or zero turn radius vehicle which may have the added feature of being convertible between a powered vehicle & a trailer.

2. Description of the Related Art

Current state of the art vacuum boring and mud recovery systems have a vacuum container having the ability to be filled and store liquid and solid particles. After filling said vacuum container to a predetermined capacity, the vacuum producing device must be discontinued, the filling must discontinue, the vacuum environment within the vacuum container is eliminated, the container opened and the contents dumped out. After the container is emptied, the vacuum-producing device may be restarted and the filling and storing may restart. Currently, vacuum containers capable of vacuuming mud and boring earth are operated as a batch process. The vacuum debris container is mounted horizontal and filled with debris. After it is full of debris a hydraulic jack tilts the tank for unloading. The vacuum tank, water tank, and other support equipment are each mounted separately on a trailer or truck bed, thus consuming a lot of floor space.

The primary objective of the present invention is to provide a means to accomplish a compact, concentrated weight, vacuum boring & excavation system by creating a vacuum container mounted at a sufficient incline to allow debris to be empted out by gravity and to provide space beneath the debris tank to locate a water storage container.

It is yet another objective of the invention to provide a means of separating the stored contents by predetermined category and dispensing them without stopping the vacuum fill and store operation or eliminating the vacuum environment within the vacuum container.

It is yet another objective of the present invention to provide an articulated powered vacuum conduit boom with sufficient structural strength to allow an operator to move and control the location of the suction end of the vacuum conduit and said suction end of said vacuum conduit have an earth digging bucket mounted adjacent it, and said conduit boom with said earth digging bucket being mounted on a mobile vehicle, and a preferred vehicle being a powered zero turn radius vehicle having the ability to be converted into a tow able trailer configuration for the purpose of transporting from job to job.

It is yet another objective of the present invention to provide a vacuum conduit boom with sufficient structural strength, power and articulated movement to allow an operator to move and control the location of the suction end of the vacuum conduit into a manhole lateral line along with a jetter spray nozzle.

It is yet another objective of the present invention to provide an articulated powered vacuum conduit boom with sufficient structural strength to allow an operator to remotely move and control the location of the suction end of the vacuum conduit with one or more attachments adjacently attached to the suction end of said vacuum conduit and said attachments being chosen from an earth digging bucket, a telescoping vacuum conduit, sensor to locate buried utilities, monitors and controls to operate the attachments and their function, water spray nozzle, manhole cover remover, cutting tool, grinding tool, saw, blasting tool, surface cleaning tool, demolition tool, torque wrench, tractor to pull vacuum hose, jetter nozzle, or camera and power source to operate them.

It is yet another objective of the present invention to separate hydrocarbons from the contents vacuumed into the vacuum container.

It is yet another objective of the present invention to provide a means to purify or sterilize the contents vacuumed into the vacuum tank.

SUMMARY OF THE INVENTION

The above described objectives and others are met by a method comprising a device which will create a vacuum condition within a vacuum container and the vacuum container being mounted on a sufficient incline to allow debris to be empted out by gravity and to provide space beneath the debris tank to locate a water storage container and having a vacuum conduit to transport liquid and or solid particles into the vacuum container. A dispensing device may be added to dispense a liquid or a solid from the vacuum container without eliminating the vacuum environment within the vacuum container, and said vacuum container having the ability to fill, store and dispense its contents simultaneously. The vacuum container may further comprise a means to separate a liquid from solids. The vacuum conduit boom used to transport debris into the vacuum container may have the added feature of being an articulated powered vacuum conduit boom with sufficient structural strength to allow an operator to remotely move and control the location of the suction end of the vacuum conduit with one or more attachments adjacently attached to the suction end of said vacuum conduit and said attachments being chosen from an earth digging bucket, a telescoping vacuum conduit, sensor to locate buried utilities, monitors and controls to operate the attachments an their function, water spray nozzle, manhole cover remover, cutting tool, grinding tool, saw, blasting tool, surface cleaning tool, demolition tool, torque wrench, tractor to pull vacuum hose, jetter nozzle, or camera and power source to operate them.

DETAILED DESCRIPTION OF THE PREFERRED EMBODIMENTS

Using the drawings, the preferred embodiments of the present invention will now be explained.

Figure 1:
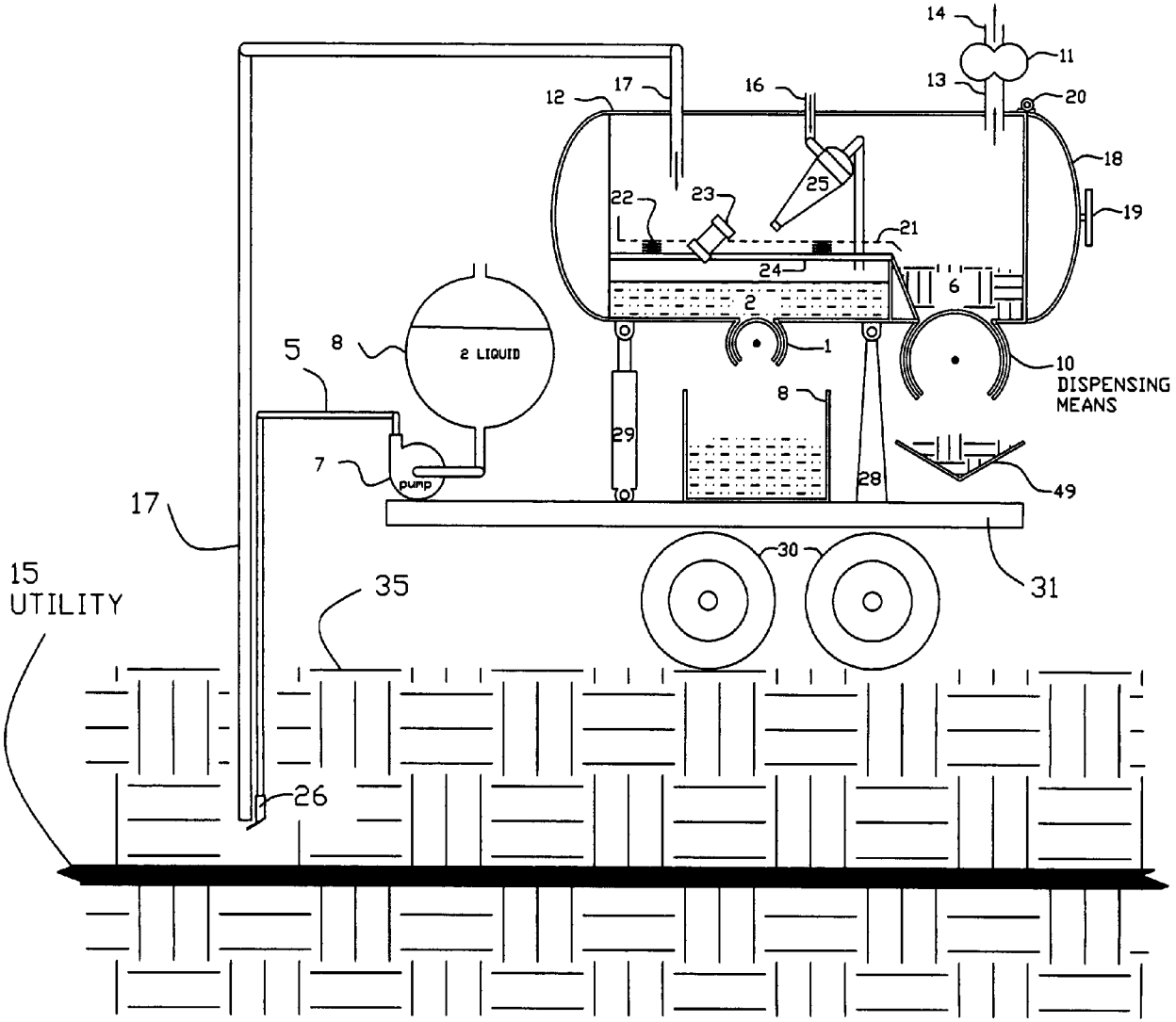
FIG. 1 shows a vacuum container according to a first embodiment of the invention having both liquid and solid dispensers and means disposed within the container to separate liquids from solids.

FIG. 1 shows the first embodiment of the invention, being one example of various possible arrangements of apparatus within a vacuum container 12 for the purpose of accomplishing a method of separating solids 6 or liquids 2 by predetermined category and then dispensing said solids 6 or liquids 2 using a dispensing means 1 without eliminating the vacuum environment within the vacuum container 12. In FIG. 1, the apparatus of the present invention include a vacuum container 12, a vacuum producing means 11, a conduit 13 to allow air to move from vacuum container 12 to vacuum producing means 11, a second conduit 14 dispenses air from the vacuum producing means 11. Vacuum container 12 has an access door 18 having a hinge 20 and a latching means 19. Solids 6 or liquids 2 are vacuumed into vacuum container 12 by means of a vacuum conduit 17. In FIG. 1, the ground 35 is earthen dirt. Liquid 2, which has been stored in container 8, is pumped by pump 7 through pump discharge conduit 5 to a spray nozzle 26. The pressurized liquid 2 dislodges and emulsifies the ground 35 so it becomes vacuum able. The vacuum able ground 35 and liquid 2 are vacuumed through conduit 17 and into vacuum container 12. The solids 6 and liquids 2 fall onto a screen 21 which is vibrated by vibrator 23. Screen 21 is mounted on springs 22 which are supported by support means 24. Liquid 2 passes through screen 21 and is dispensed from the vacuum container 12 by means of a liquid dispenser means 1 which is shown as a rotary void style in this example. The solids 6 which are too large to pass through the vibrating screen 21 are vibrated to a solids dispensing means 10 which in this example is a rotary void style dispenser. The solids 6 are dispensed into solids conveyor 49. The vacuum container 12 is supported by a pivot arm 28 and a cylinder 29 which may be extended to dump contents out of container access door 18.

The above system is mounted on a mobile platform 31 with wheels 30. FIG. 1 is shown excavating ground 35 in order to locate a utility 15 without doing damage to said utility 15.

Figure 2:
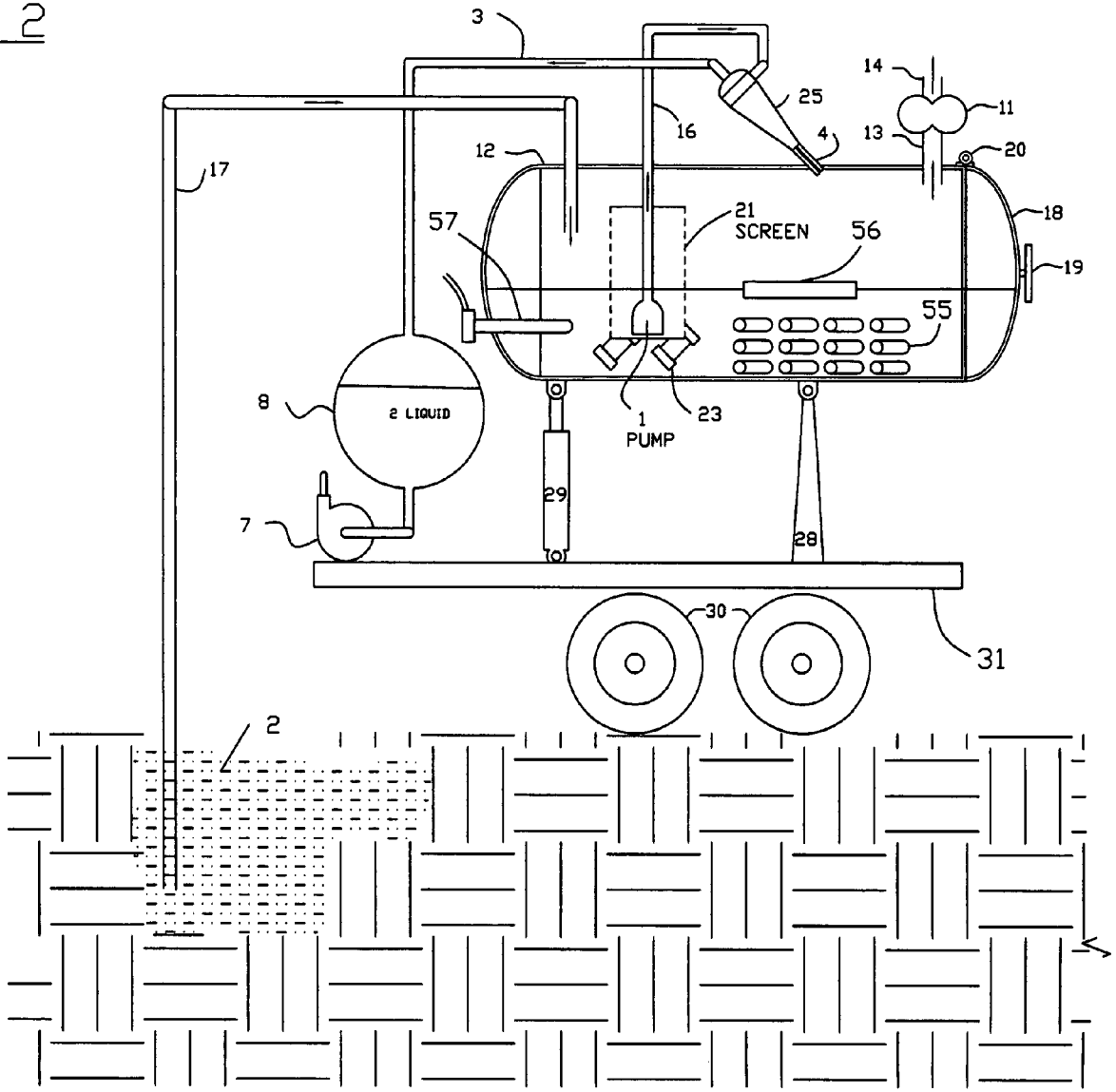
FIG. 2 shows a side elevation of a vacuum container according to a second embodiment of the invention using a screen cylinder to separate liquids from solids and having a pump dispenser disposed within the screen and having a vibrator attached to the screen. Purification means are disposed within the vacuum container to remove contaminants from the liquids or solids. Purification means 55, hydrocarbon absorbing means 56 and sterilization means 57 are shown disposed within the vacuum container although they can be attached to the container or conduits. Purification, hydrocarbon absorbs ion or sterilization means may chosen from, but are not limited to, zealite, ozone or activated carbon or ultra violet light or phasing or ultra sonic or chlorine or peat or diatomasious earth.
Figure 3:
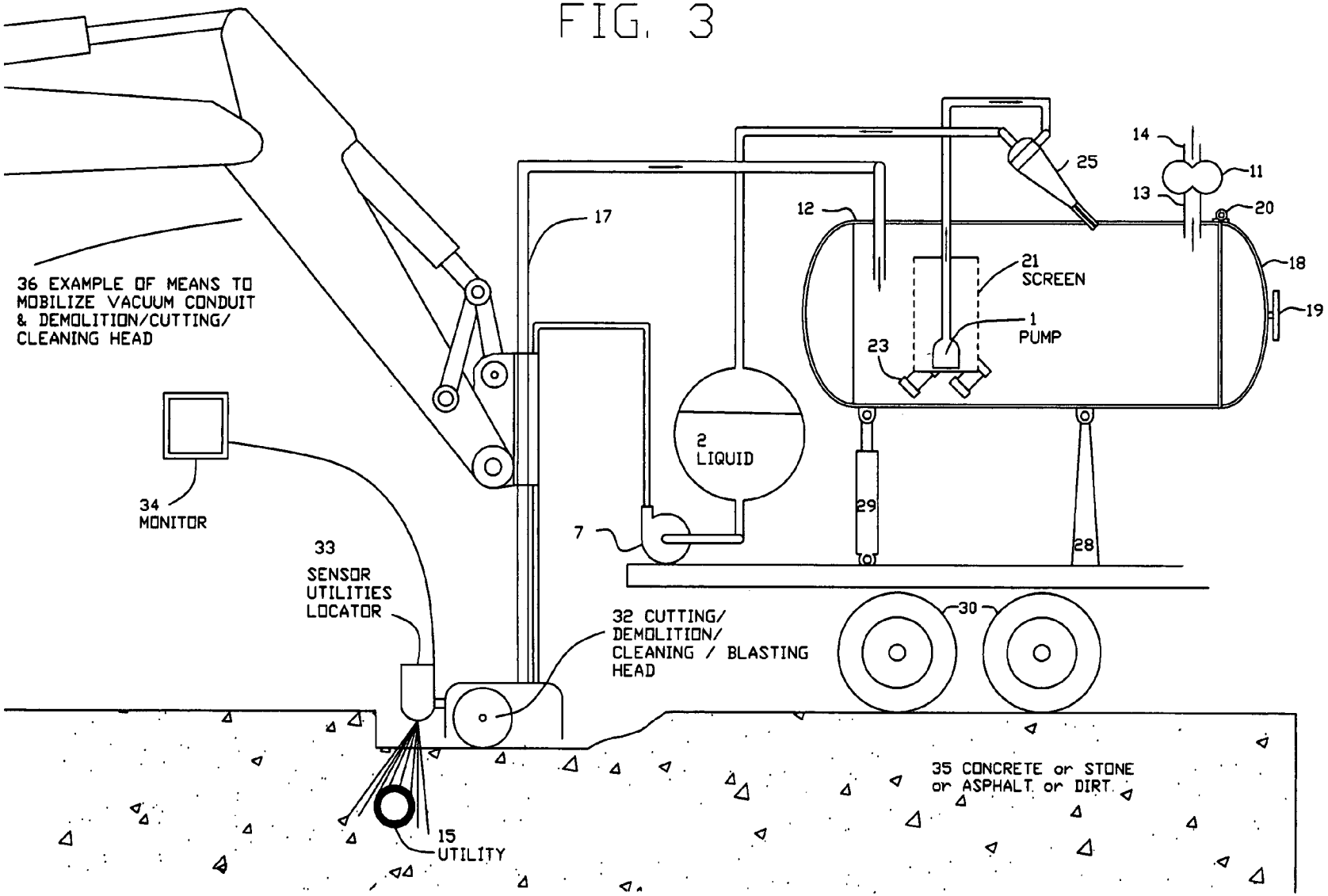
FIG. 3 shows a vacuum container and liquid dispenser according to the second embodiment of the invention using a powered boom to articulate the vacuum conduit with vacuum conduit suction end attachments, sensors & controls.

In a second embodiment of the invention shown in FIGS. 2 and 3, the screen 21 is formed in the shape of a cylinder. The solids 6 and liquids 2 which are vacuumed through conduit 17, are deposited into vacuum container 12 around the vibrated screen well 21. The solids 6 which cannot pass through the screen well 21, remain in the vacuum container 12 to be dumped out through access door 18 when it is opened and cylinder 29 is extended. Liquid 2 passes through screen 21 thus dewatering the solids 6 which remain in vacuum container 12. Liquid 2, which passes through screen 21, is dispensed from vacuum container 12 by means of liquid dispenser 1, which in this example is a pump. The liquid 2 passes through conduit 16 and into hydrocyclone 25 where the solids 6 and liquid 2 separation is further refined. The solids 6 are discharged through solids discharge conduit 4 into vacuum container 12 and liquids are discharged through conduit 3 which discharges into a liquid 2 storage container 8 thus providing a method to reclaim and recycle vacuumed liquids 2. Purification elements 55 such as ozone, activated carbon or zealite, hydrocarbon absorbing means 56 and a sterilization means 57 is located within the vacuum container 12. in order to purify, sterilize or remove hydrocarbons from the liquids 2 or solids 6 as they pass through vacuum container 12. The sterilization means 57, or purification means 55 or hydrocarbon means 56 may also be disposed within the suction conduit 17 or dispensing conduit 16, or dispensing means 1 or 10.

FIG. 3 has the added features of a mobilization means 36 being a powered mobile boom to articulate the movement of vacuum conduit 17 and vacuum conduit attachments 32 which may consist of cutters, demolition means, surface grinders, cleaners, air jets, water jets, scoops, etc. Utility location sensors 33 with monitor/controller means 34 are shown to assist in locating and accessing a utility 15 buried under ground 35 which may consist of dirt, stone, asphalt, concrete or a combination there of. The system of FIG. 3 is shown to also be recycling the liquid 2 as it locates, uncovers or avoids a utility 15.

Figure 4:
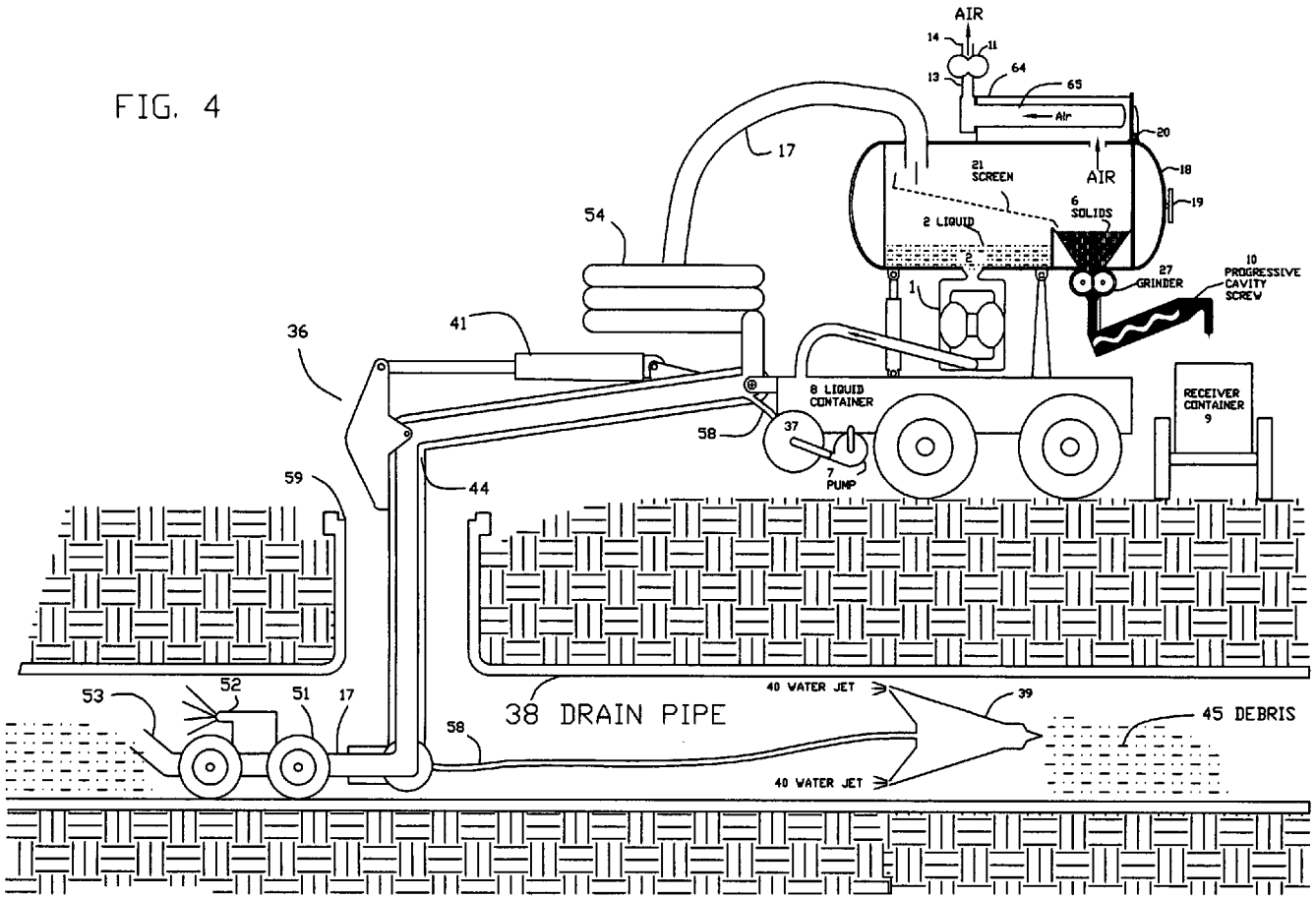
FIG. 4 shows a vacuum container with liquid and solid dispensers according to a third embodiment of the invention using an articulated vacuum and jetter boom to reach into a lateral line of a drain pipe. A vacuum conduit tractor is shown pulling a vacuum conduit & the tractor is shown with a rotating vacuum nozzle, controls, light and camera. A jetter is also shown loosening debris to be vacuumed. The vacuum container is shown to separate solids & liquids. The liquid is shown to be dispensed and recycled. The solids are shown to be ground to a smaller size, and transported to a mobile container.

In a third embodiment of the invention shown in FIG. 4, the solids 6 are passed through a solids grinder 27 in order to reduce the solids 6 size to a predetermined size before being dispensed by a solids dispenser 10 which in this example is a progressive cavity screw. The dispensed solids are collected in solids receiver container 9 to be hauled off. The liquid 2 is shown being dispensed by liquid dispenser means 1, which in this example is a diaphragm pump. The recycled liquid 2 is pumped through hose reel 37 by transfer pump 7 to a water jetter 39 spraying a water jet 40, thus cleaning drain pipe 38 with recycled water as it moves.

The recycled liquid 2 along with solids 6 washed from drain pipe 38 are vacuumed up by the vacuum conduit 17 which is shown as an articulated powered vacuum conduit boom 36. The articulated powered boom 36 also has means to place the jetter 39 into location down a manhole 59 and into a lateral drainage conduit 38 and dispense the jetter conduit 58. In this example, telescoping cylinder 41 is used to articulate the vacuum conduit boom 36 and jetter 39. Vacuum boom structure 44 allows the vacuum conduit 17 to be rigid enough to move, support weight and force in order to articulate and operate attachments such as the vacuum conduit tractor 51 which is articulated into a starting position by the vacuum conduit boom 36. Vacuum conduit powered tractor 51 then moves vacuum conduit 17 to debris 45 to be vacuumed. Vacuum hose reel 54 unreels and retracts vacuum hose 17 as needed. Vacuum conduit tractor 51 can have a sensor controller means 52 attached so as to monitor and control the vacuuming process. Vacuum conduit tractor 51 can also be fitted with an articulating suction head means 53, which allows the vacuum conduit tractor to access debris 45 in multiple degrees. Although the articulating vacuum conduit boom 36 is shown vacuuming debris from a drain pipe, said vacuum conduit boom 36 works equally well vacuuming substances from railcars, barges, tankers, silos, or shavings and dung from the barn and stables.

Figure 5:
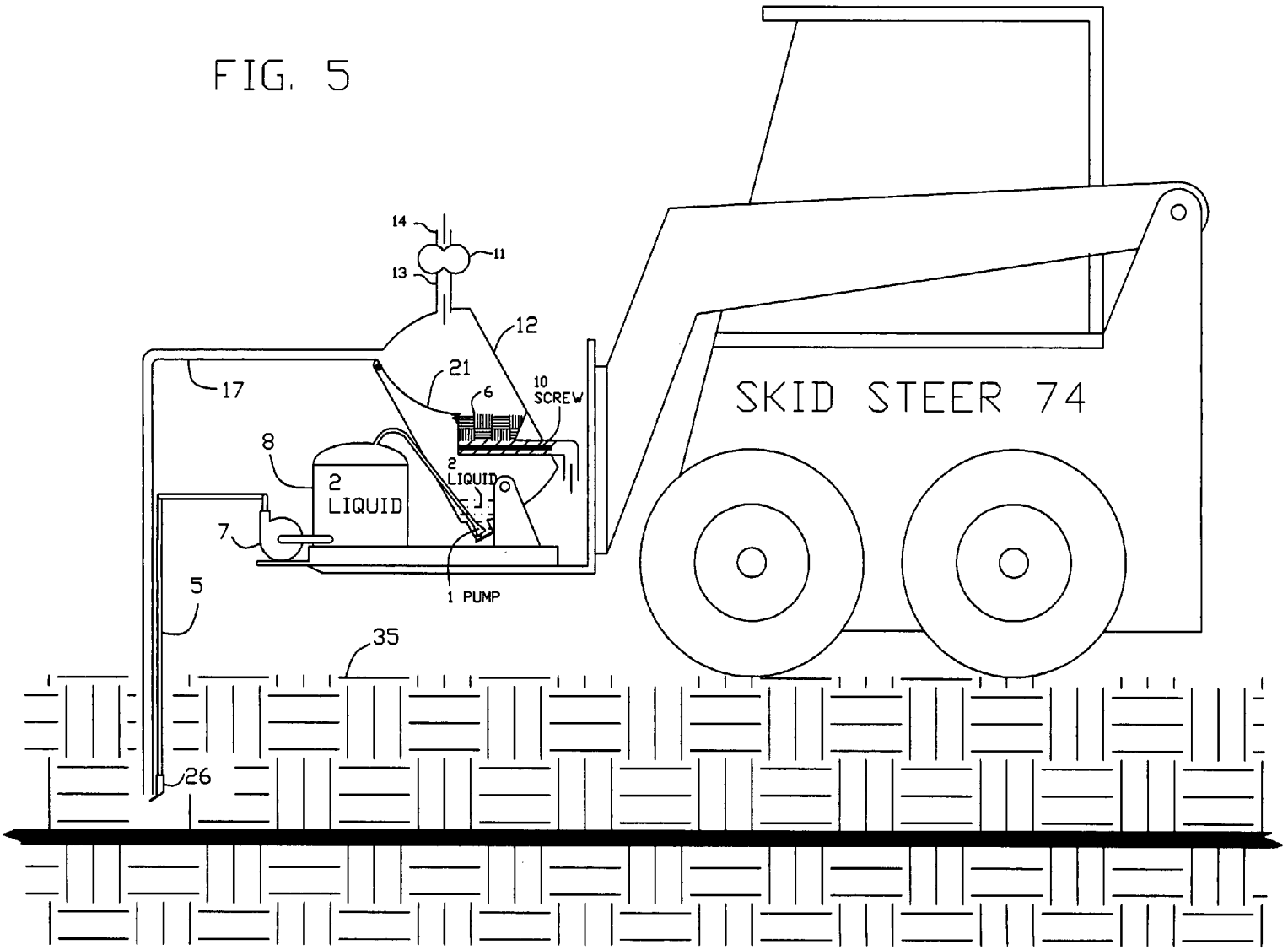
FIG. 5 shows an inclined slope vacuum container with a liquid storage container mounted under the slope of the vacuum tank. Both solid and liquid dispensers are shown according to a fourth embodiment of the invention. The vacuum unit is mounted on a platform and is shown being moved by a skid steer. The liquid is shown to be recycled and the solids are shown to be dispensed.
Figure 6:
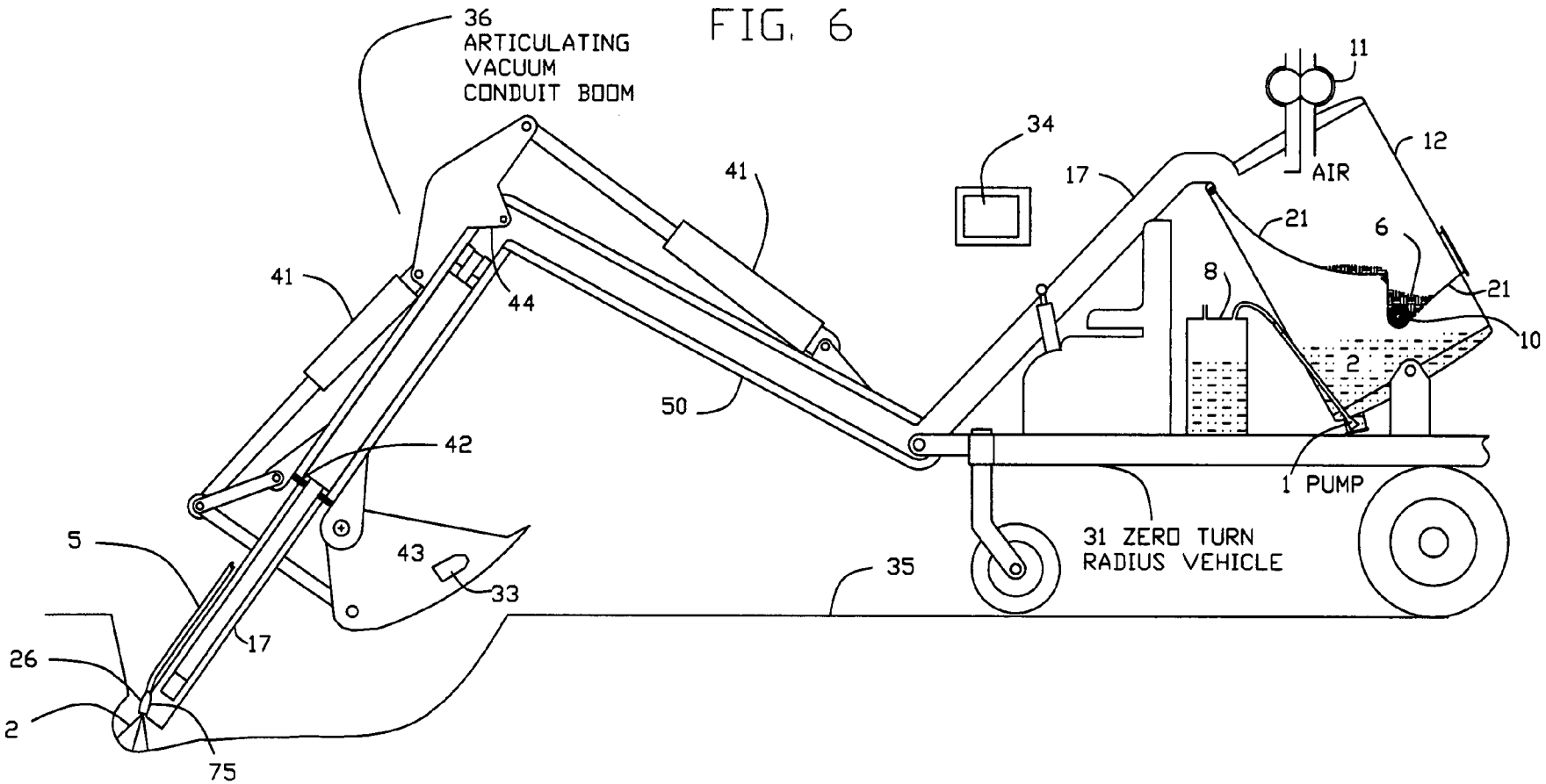
FIG. 6 shows a vacuum container according to the fourth embodiment of the invention mounted on a zero turn radius vehicle using a powered articulating vacuum conduit boom with telescoping conduit and earth digging bucket. The vacuum conduit is shown with the telescoping section of the vacuum conduit extended, and a liquid spray nozzle or air pressure nozzle is shown to be loosening the earth so it can be vacuumed. The earth digging bucket is shown in the retracted position. An earth penetrating sensor is shown mounted on the bucket.

In a fourth embodiment of the invention shown in FIGS. 5, & 6 the container 12 is placed on an inclined slope which also creates a location beneath vacuum container 12 to locate a water storage container 8, thus providing a compact vacuum container with water tank 8 system. The vacuum container 12 having an inclined screen 21, which continues as a portion of the solids dispenser 10 hopper. In this example, the solids dispenser 10 is in the form of a screw conveyor. Liquid 2, which passes through the screen 21, is dispensed by liquid dispenser 1, which in this embodiment is shown as a pump.

In FIG. 5, the system is skid mounted and being mobilized on a skid steer 74. A forklift, track vehicle, rail road car, truck, backhoe or track hoe may be used as well.

FIG. 6 illustrates an earth excavator which con alternate between the use of vacuum excavation & bucket 43 excavation. This is illustrated in this example by a vacuum container 12, with its components, mounted on a zero turn radius vehicle 31. An articulated powered vacuum conduit boom 36 is also mounted to the zero turn radius vehicle 31. The articulated powered vacuum conduit 17 boom 36 is constructed with sufficient strength to mount & operate an earth digging bucket 43 adjacent to the suction end of the vacuum conduit 17. The added means of a telescoping 42 section of vacuum conduit 17 extended to vacuum excavate or may be retracted to allow use of a bucket 43 for digging. The suction end of the telescoping 42 vacuum conduit 17 is shown to have a liquid spray nozzle 26 attached to the outer circumference of an indention 75 in the suction end of the vacuum conduit 17. The indention serves both to restrict the size of a solid entering vacuum conduit 17 to a size too small to get clogged in the conduit 17 & to serves as a location to mount the spray nozzle 26 at an orientation which will aim the s liquid 2 spray in a direction which will loosen & emulsify the earth 35 located at the suction end entrance of vacuum conduit 17. Controller 34 represents the sensors & monitors used to automate the sequencing of the articulation of the vacuum conduit boom 36 into location, the locating of utilities 15 by earth penetrating utility sensor 33, and the selection between & sequencing between earth digging bucket 43 & telescoping 42 vacuum conduit 17 & liquid spray nozzle 26. In this illustration a liquid spray nozzle 26 is shown to be used to loosen the dirt, but an air pressure nozzle may be substituted for the liquid spray nozzle 26 to loosen dirt thus making it vacuum able. A liquid 2 supply conduit 5 is shown to be mounted adjacent to the vacuum conduit 17 boom 36.

Figure 8:
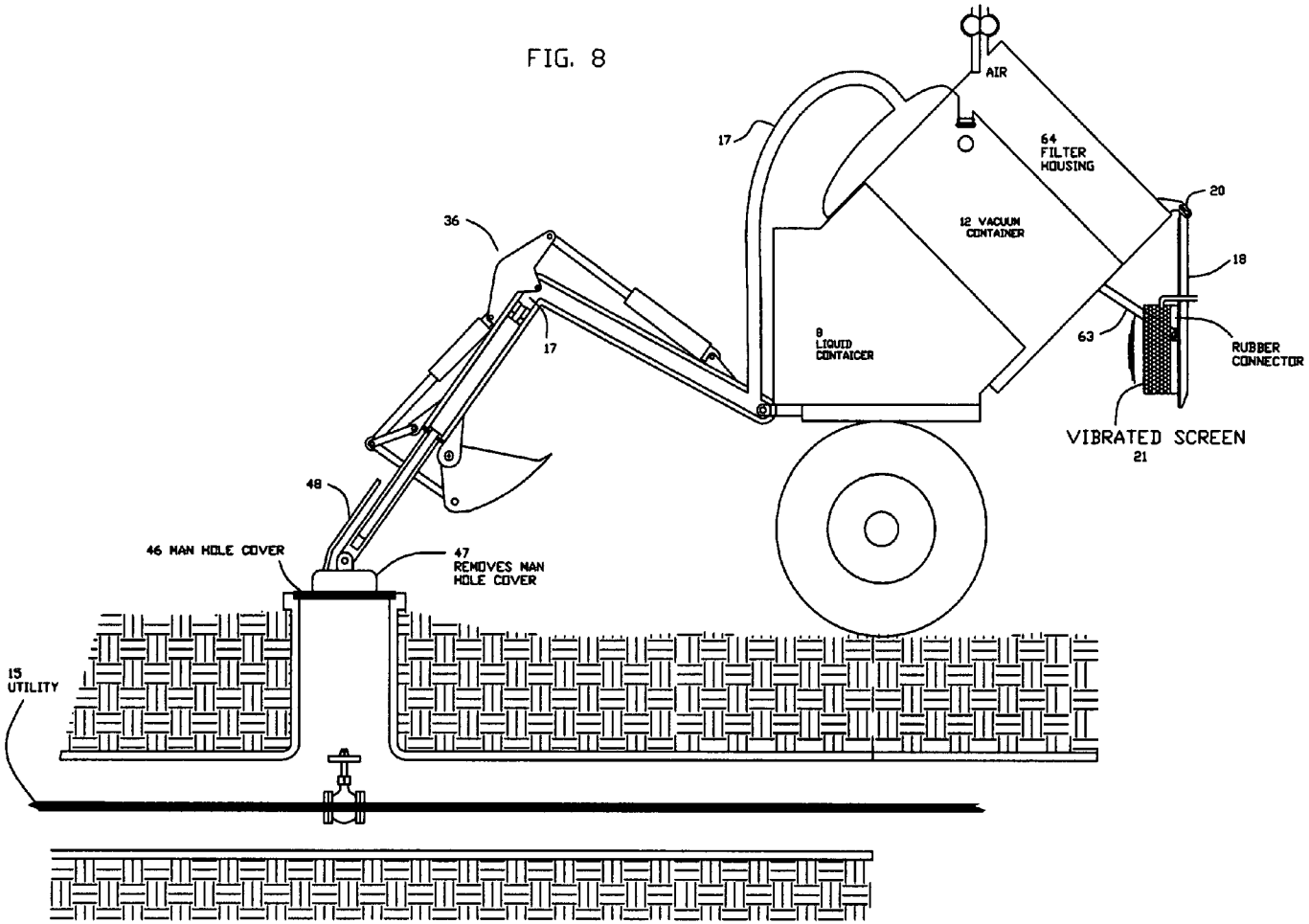
FIG. 8 shows an inclined slope vacuum container supported by a liquid storage container mounted under the slope of the vacuum tank. A filter housing containing filters is shown mounted adjacent to the debris tank. A single door is shown to access both the filter house and the debris tank simultaneously. A solids liquid vibrating screen separator is shown mounted to the debris tank portion of the access door. A powered telescoping cylinder or linear actuator is shown to open or close the access door. A powered articulating vacuum boom is shown with a manhole cover removal attachment.

FIG. 8 shows a vacuum boring & mud recovery system similar to FIG. 6 preparing to clean a drainage pipe 38. A manhole cover 46 is being removed to gain access to the drainage pipe 38 by a manhole cover 46 removal attachment 47 mounted to the articulated powered vacuum conduit boom 36. A conduit 48 supplies power to the manhole cover removal attachment means 47. The manhole cover removal attachment means 47 may be an electro magnet, a suction cup or a mechanical attachment means. FIG. 8 represents a fifth embodiment of the vacuum container 2 showing the vacuum container 2 mounted on an inclined slope, supported by a liquid container 8 located beneath the incline of the vacuum container 12, and mounted on a generic mobile platform. The inclined angle is sufficient to allow the contents of the vacuum container to be removed by gravity when the door 18 is opened. A filter housing 64 having air filters disposed within it, is shown mounted adjacent to the vacuum container 12 in a configuration to allow simultaneous access to it & the debris tank 12 by a single door 12. A powered telescoping cylinder 63, chosen from a linear actuator or hydraulic, or air cylinder is shown mounted within the vacuum container 12 and to the access door 18. This telescoping cylinder 63 opens or closes the access door 18. A vibrating screen 21 is shown mounted to the access door 18 in this illustration. Mounting the vibrating screen 21 solids 6 liquids 2 separator to the access door 18 allows improved access for emptying & cleaning.

Figure 7:
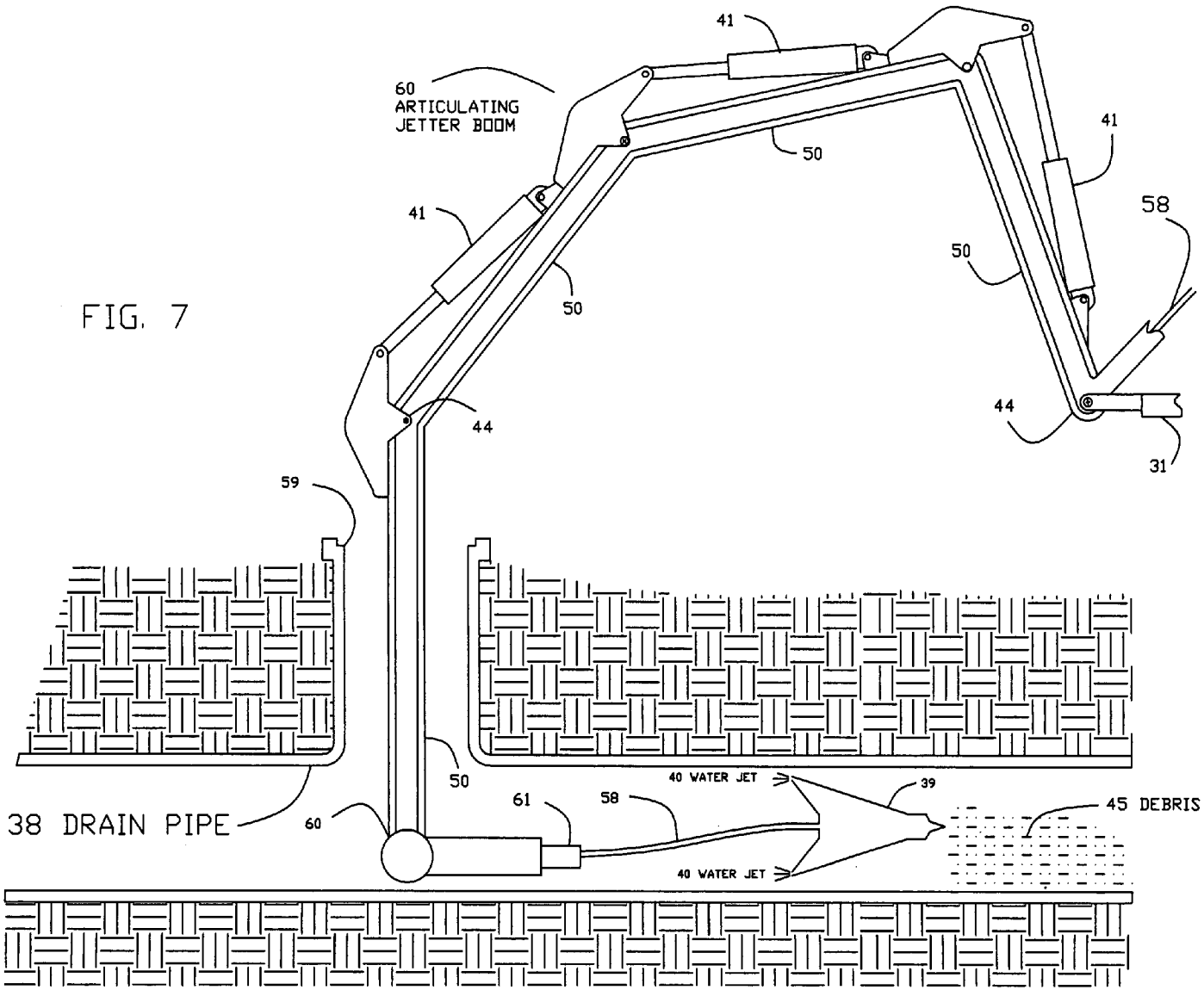
FIG. 7 shows an articulating vacuum conduit boom with multiple sections reaching into a drainage pipe lateral line to loosen & vacuum debris from the drainage pipe. A telescoping means is used to assist in reaching in the lateral line.

FIG. 7 shows an articulated powered jetter boom 60 having multiple boom sections 50 attached to a mobile platform. The boom 60 is shown loosening debris 45 from a drain pipe 38. Telescoping jetter conduit 61 provides extension of water jetter's reach. Rotary structural support means 44 provide swivel and rotating means.

Figure 9:
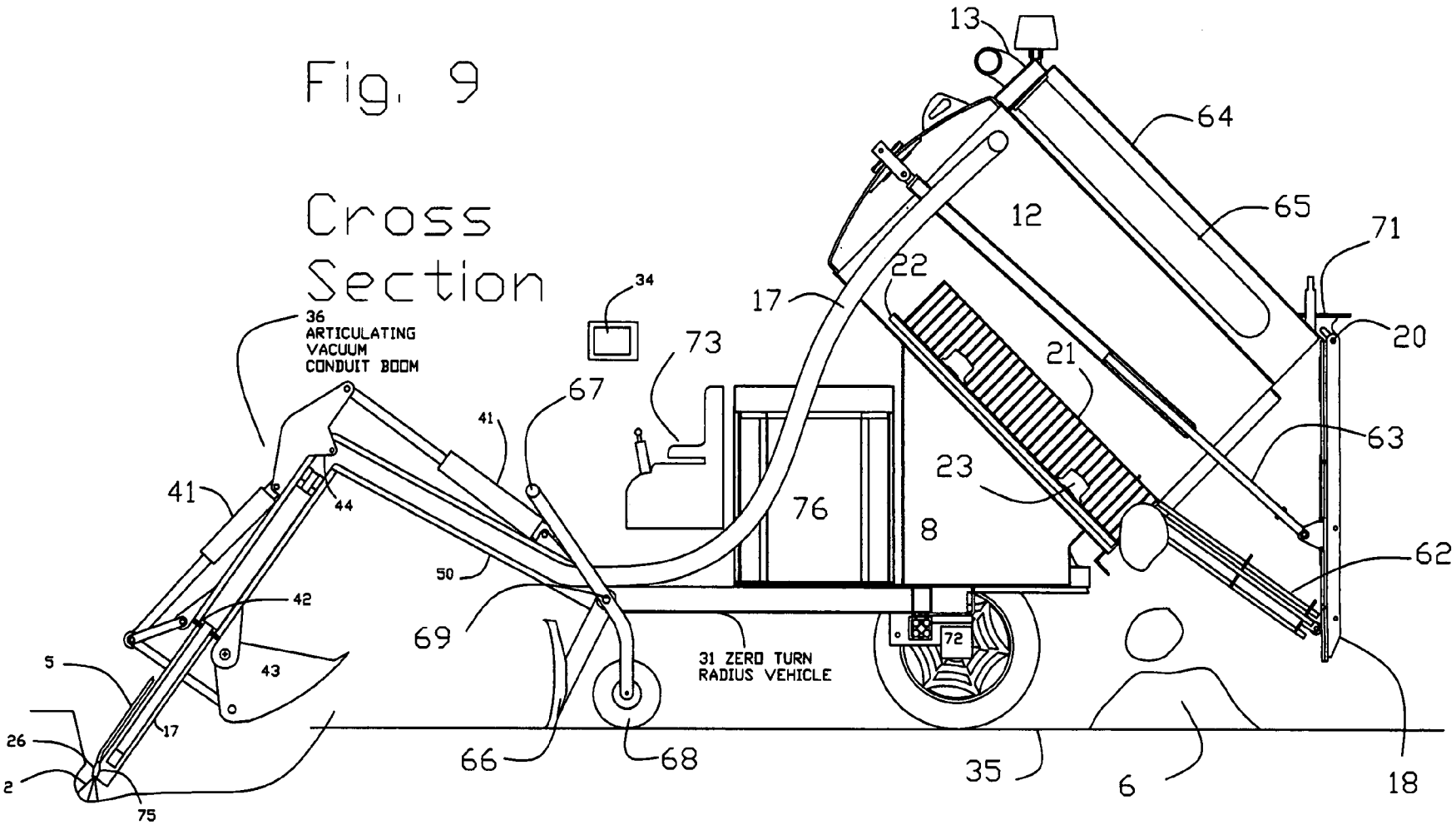
FIG. 9 Shows a cross sectional view of an earth excavator digging a hole in the earth using a vacuum container mounted on a zero-turn radius vehicle & having a solids and liquid separation and unloading means. The Vacuum container is shown connected to an articulated vacuum conduit boom with an earth digging bucket attached in the retracted position. A telescoping section of the vacuum conduit is shown in the extended position vacuuming dirt that has been by water sprayed from a liquid spray nozzle which is shown mounted in the outside circumference of an indention in the suction end of the vacuum conduit. The indention reduces the size of solid that can enter the vacuum conduit, thus reducing the frequency of solids being clogged in the vacuum conduit. The earth excavator is shown to be convertible between a zero turn radius vehicle and a tow able trailer. The excavator is shown in the excavating configuration. With the spreader blade being used as a jack. The debris access door is shown opening by a powered telescoping cylinder which in turn moves the pull bars and dried dirt out of the vacuum tank.
Figure 10:
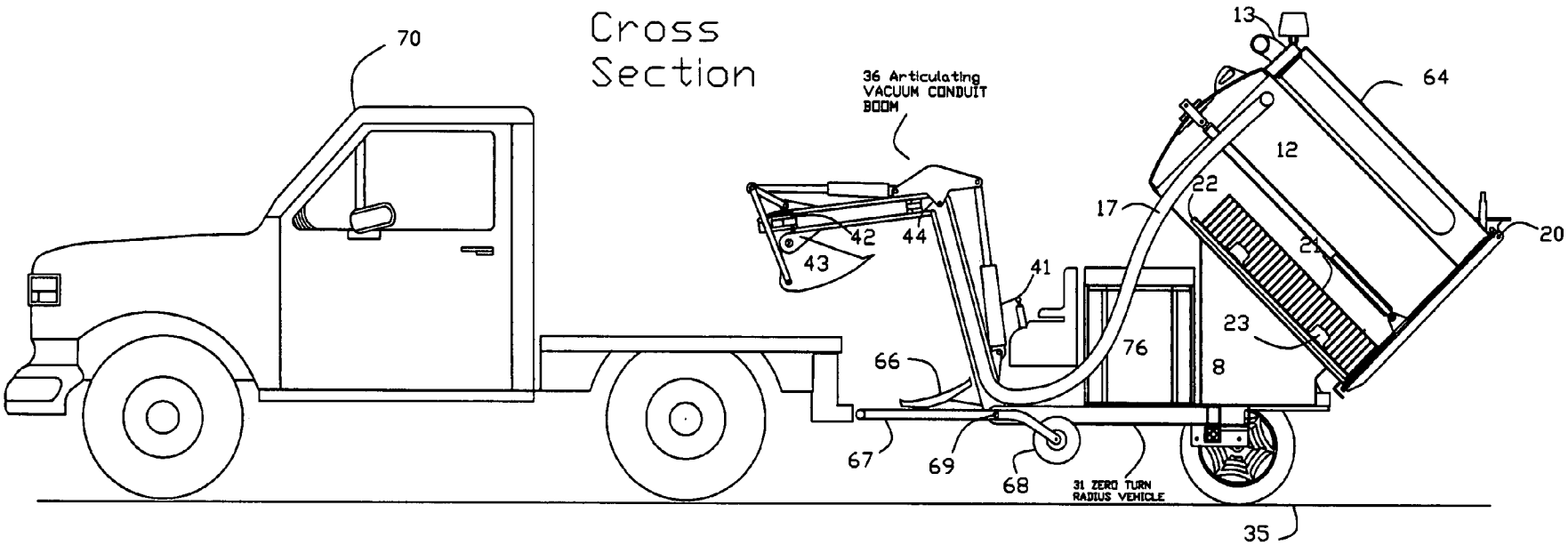
FIG. 10 Shows the earth excavator in the towing configuration as a trailer attached behind a truck. The trailer hitch has been towered & the swivel front wheels have been raised. The articulated vacuum boom has been configured into a stored position and the combination dirt pushing blade and jack has been raised.

FIG. 9 Shows a cross sectional view of an vacuum boring & mood recovery unit digging a hole in the earth 35 using a vacuum container 12 mounted on a zero-turn radius vehicle 31 & having a solids 6 and liquid 2 separation means being a vibrating screen 21 and solids unloading drag bar 62 means. The Vacuum container 12 is shown connected to an vacuum conduit 17 articulated boom 36 with an earth digging bucket 43 attached in the retracted position. A telescoping section 42 of the vacuum conduit 17 is shown in the extended position vacuuming dirt 6 that has been emulsified by water 2 sprayed from a liquid spray nozzle 26 which is shown mounted in the outside circumference of an indention 75 in the suction end of the vacuum conduit 17. The indention reduces the size of solid 6 that can enter the vacuum conduit 17, thus reducing the frequency of solids 6 being clogged in the vacuum conduit 17. The earth excavator is shown to be converted from a self propelled zero turn radius vehicle 31 to a tow able trailer, by using the scrapper blade 66 as a jack to raise the front swivel wheels 68 of the ground 35. As shown in FIG. 10 the front swivel wheels 68 may be raised and the tow bar tongue 67 may be lowered thus readying the unit for towing as shown in FIG. 10. The excavator is shown in the excavating configuration. With the spreader blade 66 being used as a jack to sturdy the machine while digging. The debris access door 18 is shown opening by a powered telescoping cylinder 63 which in turn moves the pull bars 62 and dried dirt 6 out of the vacuum tank 12. In this illustration the water tank 8 and the power plant 76 which may include an engine, hydraulic motor, vacuum pump, air compressor, water pump, muffler or controls, are both positioned beneath the slope of the inclined slope vacuum container 12 thus creating an even more compact vacuum boring & mud recovery system with an even greater concentration of weight. The water tank 8 in FIGS. 8, 9 & 10 are shown supporting the vacuum container 12. The operator controls the device from the operator seat 73. Control center 34 includes means to control solids 6 liquid 2 separation & recycling, functions of excavation, location & avoidance of utilities, mapping of work area, recording of performance.

FIG. 10 shows the device in towing position behind a towing vehicle 70.

It is recognized that while each of the figures show different types of vacuum methods, vacuum booms, vacuum containers with different types of solid or liquid separation and dispensing, the various apparatuses are interchangeable and can replace one another. Further more, although some of the articulated powered vacuum conduit booms are shown with vacuum containers having liquid or solid dispensers, it is recognized that the articulated powered vacuum conduit boom and its attachment means can be used alone or in conjunction with any type of vacuum system.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

DEFINITION

1—Dispensing means
2—Liquid
3—Liquid Discharge conduit from Hydro cyclone 25
4—Solids Discharge conduit from Hydro cyclone 25
5—Discharge conduit from Liquid transfer pump 7
6—Solids
7—Liquid Transfer pump
8—Container to hold dispensed liquids
9—Container to hold dispensed solids
10—Solids dispenser
11—Vacuum producing means
12—Vacuum container
13—Conduit to connect Vacuum container 12-vacuum producing means 11
14—Discharge conduit from Vacuum producing means 11
15—Utility
16—Inlet conduit to Hydro cyclone 25
17—Vacuum conduit
18—End door to Vacuum container 12
19—Means to secure end door 18
20—Hinge for End door 18
21—Screen
22—Spring on Screen 21
23—Vibrator
24—Support for Springs 22
25—Hydro cyclone
26—Liquid sprayer
27—Grinder
28—Pivot support for Vacuum container 12
29—Cylinder to Raise and Lower Vacuum Container 12
30—Wheels on Mobile Platform 31
31—Zero Turn Radius Vehicle
32—Cutting, Demolition, Cleaning and Blasting attachment means
33—Utility Sensor means
34—Monitor and/or Controller for Utility Sensor means 33
35—Ground Surface being dirt, asphalt, stone, or concrete
36—Articulated Vacuum conduit 17 boom with attachments 32
37—Hose Reel
38—Drain Conduit
39—Jetter
40—Water Jet
41—Means to power the Articulating Vacuum Boom
42—Telescoping Vacuum conduit
43—Digging Bucket
44—Structural Means to Support and Articulate Vacuum Conduit

45—Debris
46—Manhole Cover
47—Means to Remove Manhole Cover such as Electric Magnet, suction, mechanical fastner
48—Power to Manhole Cover removal means 47
49—Solids Conveyer
50—Boom Section
51—Vacuum conduit Tractor
52—Vacuum conduit Tractor Sensor, Controller, Camera, or light
53—Vacuum conduit Tractor Articulating Suction Head
54—Vacuum Hose Reel
55—Purification Elements such as ozone, activated carbon or zealite
56—Hydro carbon Absorbing means
57—Sterilization means
58—Jetter Hose
59—Man Hole
60—Articulating Jetter Boom
61—Telescoping Jetter Conduit
62—Solids Debris Drag Bar
63—Telescoping Rear Door Closure means
64—Filter Housing
65—Filter
66—Scraper Blade/Jack
67—Pivotable Towing Tongue
68—Pivotable/Swivel Wheels
69—Pivot Axel for Combination Tongue 67 and Wheels 68
70—Towing Vehicle
71—Boom Platform
72—Hydraulic Drive Motor
73—Operator Seat
74—Skid Steer
75—Indention in the suction end if the vacuum conduit 17
76—Power Plant

The invention claimed is:

1. A mobile vacuum boring, and excavation platform comprising: a mobile platform and having mounted on said mobile platform, a vacuum container and a liquid storage container, said vacuum container having a length and width and a vacuum producing means for creating a vacuum environment within said vacuum container, and a conduit to vacuum liquid or solids into said vacuum container, and said vacuum container being fixedly mounted on an inclined slope along said length of said vacuum container, and said inclined slope of said vacuum container being sufficient to allow said liquid or solids to dispense from said vacuum container by gravity without further inclining of said vacuum container when an access door is opened along said width of said vacuum container, and said incline slope of said vacuum container being sufficient to allow said liquid storage container to be mounted below said incline slope of said vacuum container, and said liquid storage container side walls adding structural support to said vacuum container, and further comprising a filter housing having a length and width, and said length of said filter housing being mounted on an inclined slope adjacent to said length of said vacuum container, and said vacuum container adding structural support to said filter housing.

2. A mobile vacuum boring, and excavation platform comprising: a mobile platform and having mounted on said mobile platform, a vacuum container having a length and width, a vacuum producing means for creating a vacuum environment within said vacuum container, a conduit to vacuum liquid or solids into said vacuum container, an air filter housing having a length and width, and said length of said filter housing being adjacently mounted to said length of said vacuum container, and said length of said vacuum container adding structural support to said filter housing, and said vacuum container being fixedly mounted on an inclined slope along said length of said vacuum container, and said inclined slope of said vacuum container being sufficient to allow said liquid or solids to dispense from said vacuum container by gravity without further inclining of said vacuum container when an access door is opened along, said width of said vacuum container, and said incline slope of said vacuum container being sufficient to allow a liquid storage container to be mounted below said incline slope of said vacuum container and further comprising connecting conduit to flow air from said vacuum container into said filter housing and on to said vacuum producing means, and said filter housing having filters disposed within it to remove solids from said air.

3. A mobile vacuum boring, and excavation platform comprising: a mobile platform and having mounted on said mobile platform, a vacuum container having a length and width, a vacuum producing means for creating a vacuum environment within said vacuum container, a conduit to vacuum liquid or solid particles into said vacuum container, an air filter housing having a length and width, a liquid storage container having a length and width, and said length of said vacuum container being mounted at an incline slope sufficient to allow said liquid or solids to be dispensed from said vacuum container by gravity when an access door is opened along said width of said vacuum container, without further inclining said vacuum container, and said incline slope of said vacuum container being sufficient to allow said liquid storage container to be mounted below said incline slope of said vacuum container, and said air filter housing being adjacently mounted on said mobile platform and said filter housing having filters positioned within said filter housing.

4. A mobile vacuum boring, and excavation platform according to claim 1 or 2 or 3 , wherein a liquid is stored within said liquid storage container and a liquid pressurizing pump, a liquid conduit and a nozzle are mounted adjacent to said mobile platform, wherein said liquid is pressurized by said pump, and said liquid is flowed through said liquid conduit and nozzle to impinge earthen material in order to improve the vacuum ability of said earthen material.

5. A mobile vacuum boring, and excavation platform according to claim 1 or 2 or 3 wherein a boom having one or more arms is pivot ably mounted adjacent to said mobile platform, and said pivot ably mounted boom has adjacently mounted, one or more utility conduits selected from the group consisting of, a conduit for vacuum, a conduit for air , a conduit for liquid , an electric power conduit, and a conduit for hydraulic fluid.

6. A mobile vacuum boring, and excavation platform according to claim 1 wherein an access door is adjacently mounted to said width of said vacuum container whereby said liquid or solids can be dispensed from said vacuum tank and wherein said access door can be a single door access to both said filter housing and said vacuum container.

7. A mobile vacuum boring, and excavation platform according to claim 1, or 2 or 3 wherein an access door is adjacently mounted on said width of said vacuum container and a telescoping means is positioned within said vacuum container to open or close said access door and said telescoping means is selected from the group consisting of, a hydraulic cylinder and a linear actuator.

8. A mobile vacuum boring, and excavation platform according to claim 3 wherein a vibrating screen is positioned within said vacuum container to separate said solids from said liquid.

9. A mobile vacuum boring, and excavation platform according to claim 2, or 3 wherein said vacuum container further comprises a means for dispensing said liquid from said vacuum container without eliminating said vacuum environment within said vacuum container and said dispensing means is mounted adjacent to said vacuum container.

10. A mobile vacuum boring, and excavation platform according to claim 3, wherein said mobile platform is a vehicle that can be converted from a trailer to a powered, steer able vehicle and said vehicle further comprises a pivot able trailer hitch with pivot able wheels.

11. A mobile vacuum boring, and excavation platform according to claim 1, or 2, or 3 wherein a boom having one or more arms is pivot ably mounted adjacent to said mobile platform and said boom having an attachment means for attaching one or more tools selected from the group consisting of a hydraulic torque wrench, a hydraulic motor, a 360 degree rotating elbow, a 360 degree knuckle, a telescoping vacuum conduit, an earth digging bucket, an earth penetrating utility sensor, an earth penetrating utility locator, a man hole cover remover, a high pressure water demolition means, a sand blasting attachments, a water jetter nozzle, a camera, a vacuum conduit tractor, a concrete cutting means, an asphalt cutting means, a surface cleaning attachments, a vibrator excavation means, an aerodynamic rotary water jet surface cleaner, a multiple rotary pulse water nozzles arranged around the circumference of the suction end of a vacuum conduit, and a pressurized water conduit.

12. A mobile vacuum boring, and excavation platform according to claim 1, 2 or 3 wherein said vacuum container has adjacently mounted a means for dispensing said liquid from said vacuum container without eliminating said vacuum environment within said vacuum container and having adjacently attached to said mobile platform, one or more attachments selected from the group consisting of a means for recycling said liquid to a surface cleaning means and said surface cleaning means having a water pressure spray nozzle, a means for directing said nozzle to impinge said surface to be cleaned with said liquid, a housing to contain said liquid spray, a vacuum conduit attachment to said housing, and a vacuum conduit to vacuum said sprayed liquid from said surface cleaning means to said vacuum container.

13. A mobile vacuum boring, and excavation platform according to claim 3 wherein an earth digging excavation bucket is adjacently mounted to the suction end of said vacuum conduit.

14. A mobile vacuum boring and excavation platform according to claim 1, 2 or 3 where in an access door is adjacently mounted to said width of said vacuum container and said access door having a powered means for opening or closing said access door and said powered access door having a drag bar adjacently attached to said powered access door so as to dispose said drag bar within said solids of said vacuum container when said powered access door is closed and whereby said powered access door may pull both said drag bar and said solids out of said vacuum container as said access door is opened.

15. A mobile vacuum boring, and excavation platform according to claim 3 wherein an articulated boom having one or more arms is pivot ably mounted adjacent to said vacuum container and said articulated boom arm having an attachment means for attaching a tool whereby said attachment means may attach tools which may be used to access or service in ground utilities.

16. A mobile vacuum boring, and excavation platform according to claim 1 or 2 or 3 wherein an air compressor, an air hose and an air nozzle are adjacently mounted on said mobile platform, whereby compressed air may be used to impinge earthen material in order to loosen said earthen material thus making said earthen material more vacuum able.

17. A mobile vacuum boring, and excavation platform according to claim 1, 2 or 3 wherein a process monitor is adjacently mounted on said mobile platform whereby said process monitor may receive or display or transmit information related to the excavation of in ground utilities or the servicing of in ground utilities.

18. A mobile vacuum boring, and excavation platform according to claim 2 or 3 wherein said conduit to vacuum liquid or solids into said vacuum container further comprises a restriction to the suction end of said vacuum conduit, whereby solids large enough to clog said conduit are restricted from entering said conduit.

19. A mobile vacuum boring, and excavation platform according to claim 15 wherein said boom has a powered means for securing said boom arm in a position while said attached tool is being used to access or service an in ground utility.

20. A mobile vacuum boring, and excavation platform according to claim 15 wherein said attached tool is a torque wrench, and wherein a process monitor is adjacently mounted on said mobile platform whereby said process monitor may receive or display or transmit information related to the excavation of in ground utilities or the servicing of in ground utilities.

21. A mobile vacuum boring, and excavation platform according to claim 1, 2 or 3 wherein said mobile platform is selected from the group consisting of a truck, a trailer, a skid, a skid steer, a forklift, a track vehicle, a rail road car, a zero turn radius vehicle, a trailer having means to convert to a zero turn radius vehicle, a backhoe and a track hoe.

22. A mobile vacuum boring, and excavation platform according to claim 15 comprising a powered means attached to said boom for articulating said boom arm.

23. A mobile vacuum boring, and excavation platform according to claim 15 comprising a powered means attached for articulating said boom arm and said powered means is controlled by wireless remote control.

24. A mobile vacuum boring, and excavation platform according to claim 15 wherein said tool is controlled by wireless remote control.

* * * * *